US006317943B1

(12) United States Patent
Wood

(10) Patent No.: US 6,317,943 B1
(45) Date of Patent: Nov. 20, 2001

(54) CASKETS

(76) Inventor: Colin Leslie Hearl Wood, 24 Brook Avenue, New Milton Hampshire, BH25 5HD (GB)

( * ) Notice: Subject to any disclaimer, the term of this patent is extended or adjusted under 35 U.S.C. 154(b) by 0 days.

(21) Appl. No.: 09/394,437

(22) Filed: Sep. 9, 1999

(30) Foreign Application Priority Data

Sep. 11, 1998 (GB) ..... 9819825

(51) Int. Cl.[7] ..... A61G 17/00

(52) U.S. Cl. ..... 27/4; 220/6; 229/186; 229/117.01

(58) Field of Search ..... 27/4, 2; 220/6, 220/4.28, 441; 229/939, 117.01, 186, 187

(56) References Cited

U.S. PATENT DOCUMENTS 4,123,831 * 11/1978 Covington ..... 27/4
4,156,956 * 6/1979 Partridge et al. ..... 27/4
4,967,455 * 11/1990 Elder ..... 27/4
5,307,545 * 5/1994 Stoltz ..... 27/4
5,353,484 * 10/1994 Woedl et al. ..... 27/4
5,586,679 * 12/1996 Thomas ..... 27/4
5,661,879 * 9/1997 Kelly ..... 27/4

FOREIGN PATENT DOCUMENTS 1168588 10/1969 (GB) .
WO 95/08973 4/1995 (WO) .

* cited by examiner

*Primary Examiner*—B. Dayoan
*Assistant Examiner*—William L. Miller
(74) *Attorney, Agent, or Firm*—Pitney, Hardin, Kipp & Szuch LLP

(57) ABSTRACT

A funeral casket of box-like form which includes a body-receiving portion and a lid portion for covering the body-receiving portion, the body-receiving portion being of foldable construction.

9 Claims, 5 Drawing Sheets

CASKETS

Figure 1:
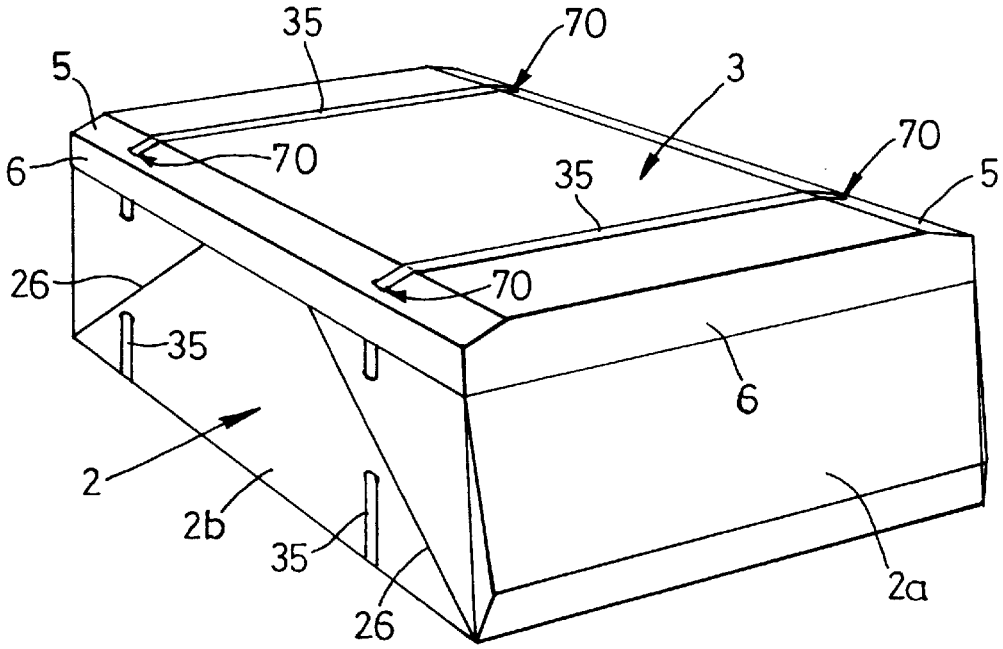

This invention relates to funeral caskets, and is primarily, but not exclusively, concerned with funeral caskets for deceased animals. It will be appreciated that the invention may also be used for deceased humans.

According to the invention there is provided a funeral casket of box-like form, comprising a body-receiving portion and a lid portion for covering the body-receiving portion, the body-receiving portion being of foldable construction such that the body-receiving portion is collapsible to adopt a relatively compact collapsed condition and may be erected to adopt a relatively upright erected condition, said body-receiving portion comprises a folded blank, the blank comprising a base of oblong-rectangular form, the base having opposite ends and opposite sides, a pair of first extensions disposed at said opposite ends of the base and connected to the base by respective first extension fold lines, the first extensions having been folded inwards on said first extension fold lines so as to form opposite ends of the body-receiving portion, and a pair of second extensions disposed at said opposite sides of said base and connected to the base by respective second extension fold lines and folded inwards about said second extension fold lines so as to form the sides of the body-receiving portion, said first and second extensions are bounded by extension margins that extend transversely of said extension fold of the respective extension, and adjacent said extension margins of said first and second extensions are connected together by respective corner connection means wherein at least one wall pair of said pair of end walls and said pair of side walls comprises articulated wall portions which fold relative to one another on bringing the body-receiving portion from the collapsed condition to the erected condition, said articulated wall portions being connected by a pair of inclined fold lines which each extend from a corner of said base at opposite ends of said walls of said one wall pair, said inclined fold lines being inclined relative to the respective said extension fold line of said articulated wall, whereby the other wall pair of said pairs of end walls and side walls maintains the same outline shape on collapsing of said body-receiving portion by folding of said walls of said other pair about the respective said extension fold lines.

Preferably the foldable construction is such that the body-receiving portion may collapse to adopt a relatively compact collapsed condition and be erected to adopt a relatively upright erected condition.

The body-receiving portion preferably contains shroud material which may also be used to line the interior of the body-receiving portion.

The body-receiving portion is preferably provided with means for at least restricting outleakage of body fluids from the funeral casket.

The funeral casket is preferably of biodegradable material.

The body-receiving portion preferably comprises a foldable blank defining a base of oblong-rectangular form with a pair of first extensions disposed at opposite ends of the base and foldable inwards so as to form the ends of the body-receiving portion, and a pair of second extensions disposed on opposite sides of the base and foldable inwards so as to form the sides of the body-receiving portion.

The first and/or the second extensions may be foldable back on themselves to strengthen still further the body-receiving portion.

The invention also comprises the blank per se.

The funeral casket may be provided with filamentary members such as ribbons; initially to secure the (folded) body-receiving portion and the lid portion together and which may subsequently be used to lower the assembled casket into a grave.

The arrangement is preferably such that vertical tensioning of the ribbons causes said collapsed body-receiving portion to be urged towards the erected condition.

Funeral caskets according to the invention may be of varying sizes. In the case of animals, caskets may range from, for example, a small size to accommodate such animals as mice, to a large size, intended to accommodate bigger animals such as large dogs and small horses.

Figure 2:
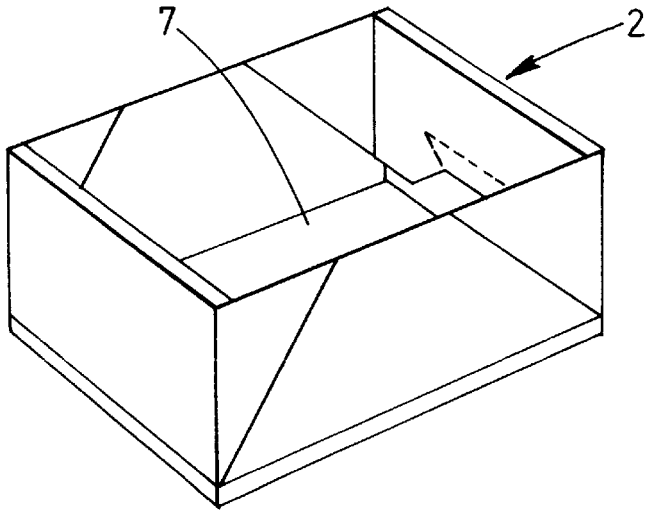
Figure 3:
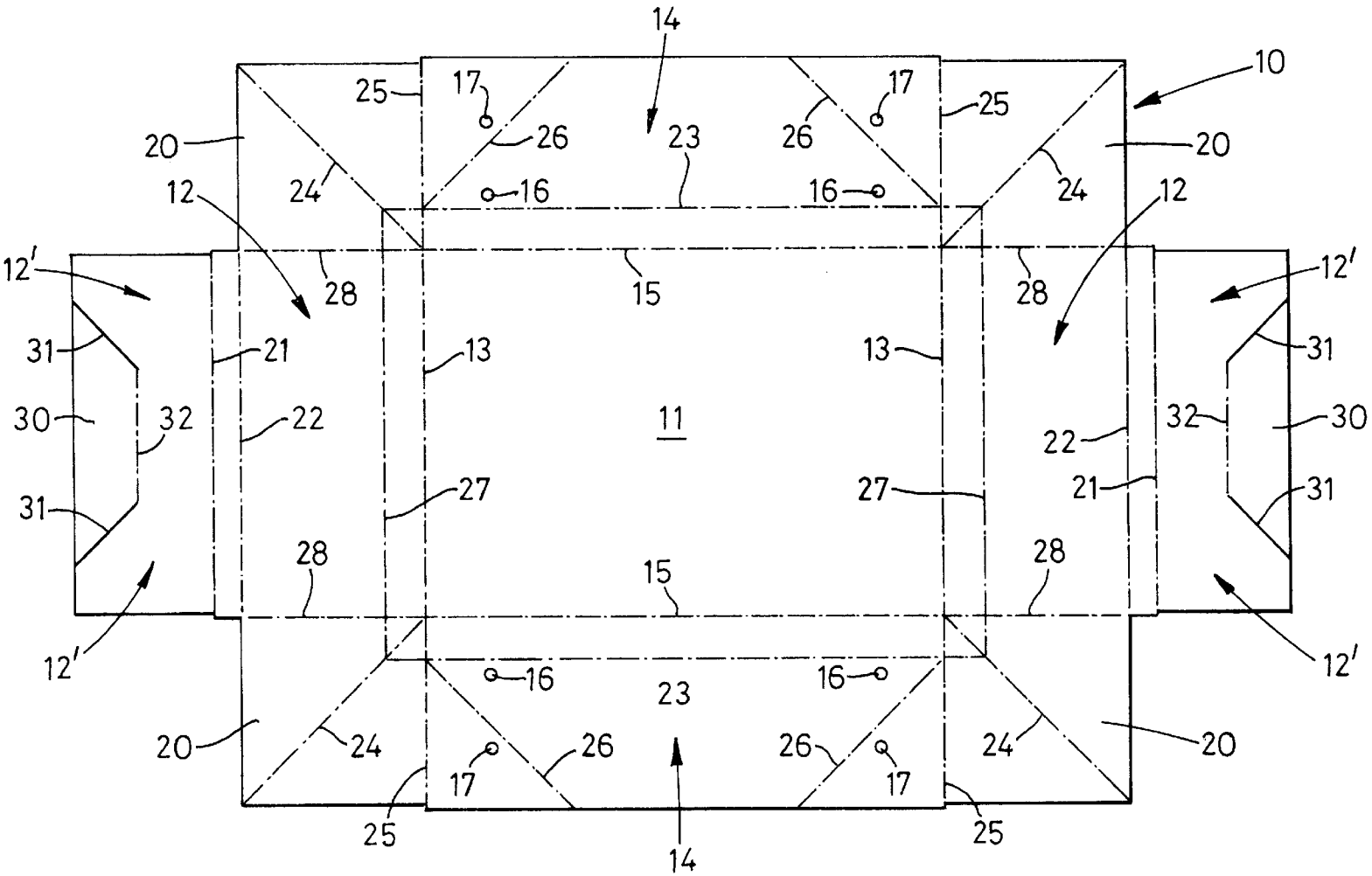
Figure 4:
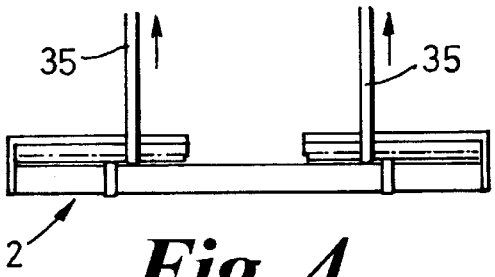
Figure 7:
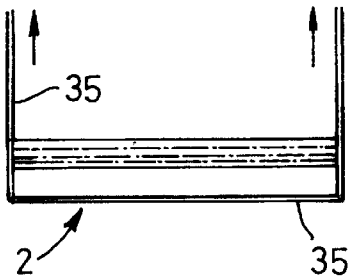
Figure 5:
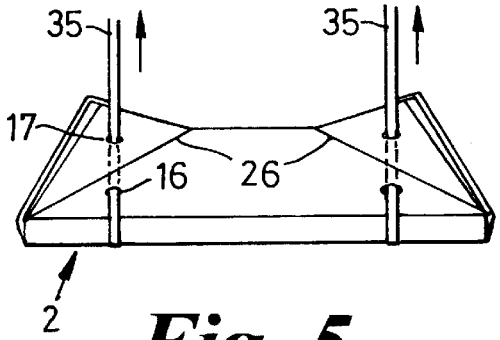
Figure 8:
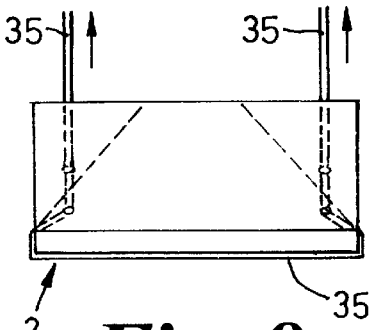
Figure 6:
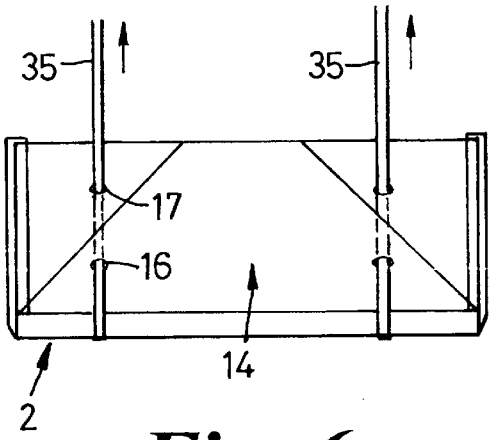
Figure 9:
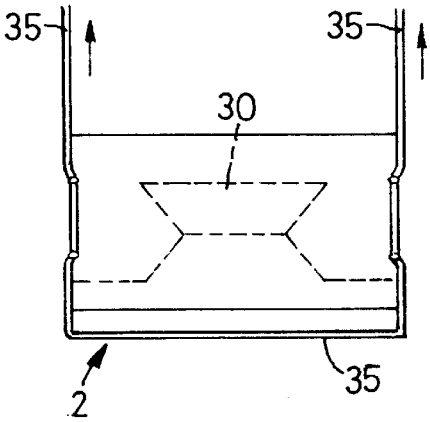
Figure 10:
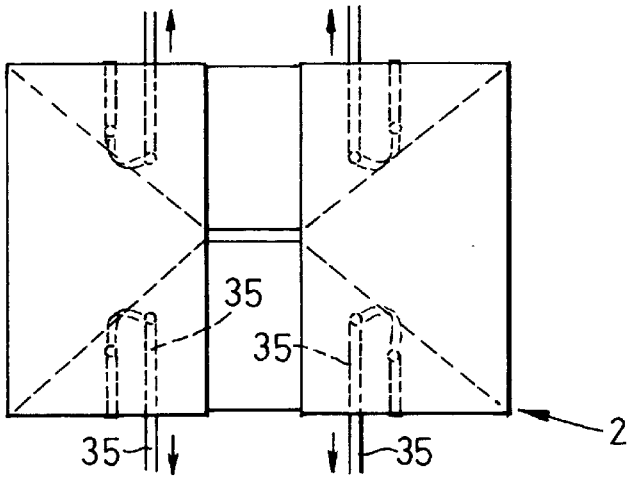
Figure 11:
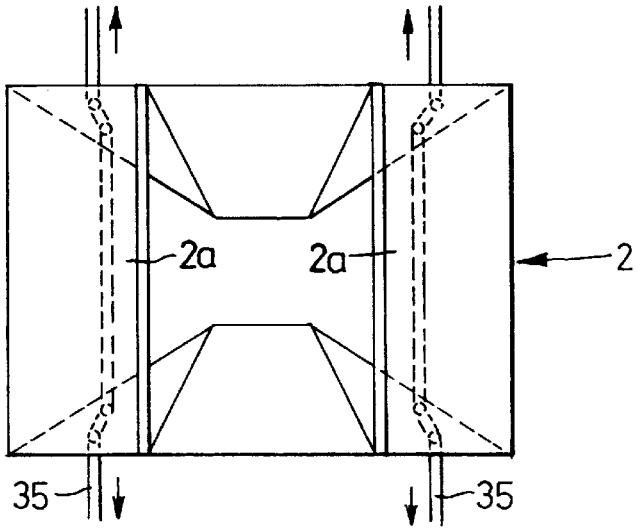
Figure 12:
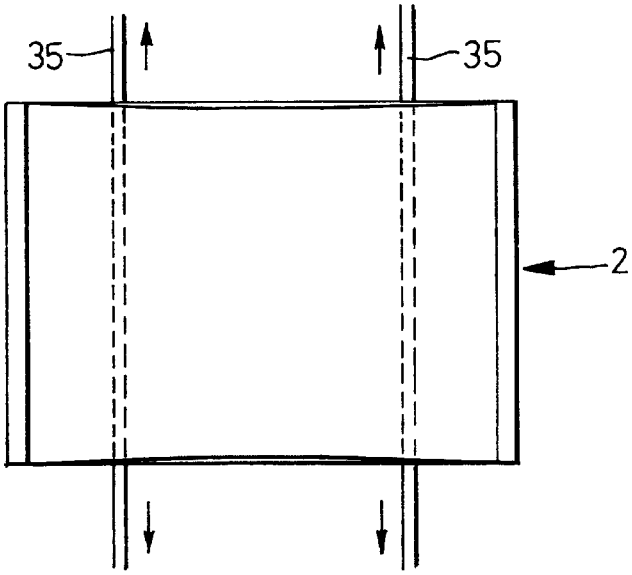
Figure 13:
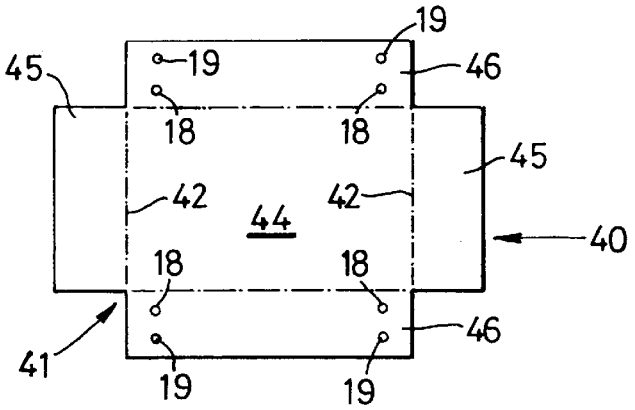
Figure 14:
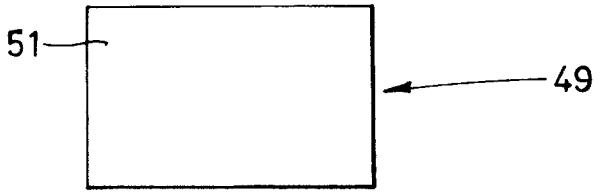
Figure 15:
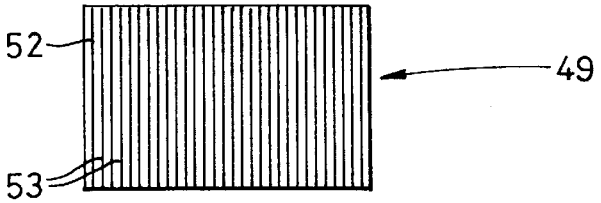

A funeral casket in accordance with the various aspects of the present invention will now be described by way of example only, with reference to the accompanying drawings, wherein:

FIG. 1 is a view in perspective of an erected funeral casket with the lid secured by ribbons, FIG. 2 is another view in perspective of the erected casket, but with the lid thereof removed, FIG. 3 is a plan view of a foldable blank used to form the body-receiving portion of the casket, FIGS. 4, 5 and 6 are side views of the body-receiving portion of the casket in fully-folded, half-folded and fully-open conditions respectively, FIGS. 7, 8 and 9 are end views of the body-receiving portion of the casket in fully-folded, half-folded and fully-open conditions respectively, FIGS. 10, 11 and 12 are plan views of the body-receiving portion of the casket in fully-folded, half-folded and fully-opened conditions, FIG. 13 is a plan view of a cradle blank which can be folded into a casket cradle in order to retain and strengthen the absorbent pack of FIGS. 14 and 15.

Figure 16:
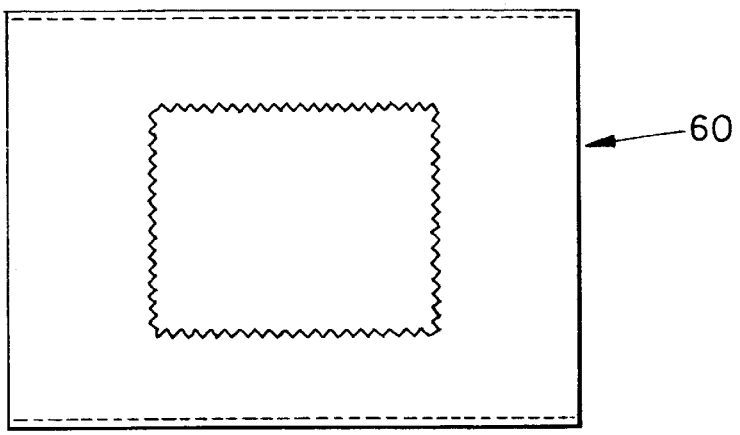

FIGS. 14 and 15 illustrate respectively, top and bottom views of the absorbent pack, and FIG. 16 is a plan view of a shroud base.

With reference to FIGS. 1 and 2, a funeral casket 1 of box-like form comprises a body-receiving portion 2 and a close-fitting lid portion 3, (not FIG. 2), for covering the body-receiving portion 2. The body-receiving portion 2 is of foldable construction.

As will be evident hereinafter, the body-receiving portion may collapse to adopt a relatively compact folded condition for transport and storage prior to use, and be erected to adopt a relatively upright opened condition.

The lid portion 3, which has an upper surface 4 with bevelled edges 5, has sides 6 which enable the lid portion 3 to fit over the periphery of the body-receiving portion 2 and so close-off its body-receiving interior 7.

The casket is of biodegradable material. In this example, the material is Kraft carton board and cotton cloth. The use of Kraft carton board is advantageous since it is of low cost, biodegradable and strong.

With reference to FIG. 3, the body-receiving portion 2 is formed from a blank 10 defining a base 11 of oblong-rectangular form, with a pair of first extensions 12 disposed at opposite ends of the base 11 and foldable inwards, (about fold lines 13), so as to form the ends 2*a* of the body-receiving portion 2 of the casket 1, and a pair of second extensions 14 disposed on opposite sides of the base 11 and foldable inwards, (about fold lines 15), so as to form the sides 2*b* of the body-receiving portion 2.

Fold lines 13 constitute first extension fold lines, and fold lines 15 constitute second extension fold lines.

The first and second extensions 12 and 14 are interconnected by four webs or gussets 20 of substantially square plan form in the flat blank, the gussets each-being provided with a diagonal fold line 24.

Other fold lines are indicated by reference numerals 21 to 27. The fold lines are scored.

Extensions 12 have respective extension tabs 12' which each have inclined cut lines 31 and a fold line 32 to define a respective end flap 30.

Each of the gussets 20 is folded on itself about diagonal line 24 into a triangular shape. Each of the said folded gussets 20 is then rotated about fold line 28 towards and against extensions 45 of a cradle blank (hereinafter described) which is inserted into the body-receiving interior 7. Extension tabs 12' are folded about the fold 22 by 180° and the respective end flaps 30 are then folded back about lines 32 (as shown in FIG. 9) and in between the folded gussets 20 and the extensions 45 so as to strengthen the extensions 12.

With reference to FIGS. 4 to 12, the body-receiving portion 2 of the casket is initially fully folded for transportation and storage, as shown in FIGS. 4, 7 and 10. In this condition, extensions 12 are folded, about lines 13, 27, 22 and 21 to form double-walled ends 2*a* of the body-receiving portion 2. Similarly extensions 14 are folded about parallel lines 15 and 23, to form the sides 2*b* of the body-receiving portion 2. The gussets 20 fold inwardly, about lines 24, and provide interconnection of the adjacent margins 25, 28 of extensions 12 and 14 and so strengthen the body portion 2. The extensions 14 are each provided with two upper holes 17 and two lower holes 16 either side of inclined lines 26. The fold lines 23, 25, 26 and 27 allow the body-receiving portion 2 to adopt a relatively flat fully-folded condition and a fully-opened erected condition.

The second extensions are each provided with a pair of inclined fold lines 26, that is the fold lines 26 are inclined with respect to the direction of fold lines 15, and the fold lines 26 extend substantially from opposite end corners of the base 11. The fold lines 26 provide articulation of the second extensions 4 that is the second extensions 14 are each divided into articulated portions by the fold lines 26, and this articulation of the second extensions 14, which form the side walls of the body-receiving portion, enables the ends of the body-receiving portion to be folded inwards about fold lines 13 in going from an erected condition of the unit to a collapsed condition whilst retaining the same outline shape of the ends. Since the ends are relatively rigid, this facility is important in allowing the collapsed body-receiving portion to be of minimum overall plan area, thereby enabling the lid portion to cover the body-receiving portion in the collapsed condition.

With reference now to FIGS. 13 and 14, the assembled casket 1 is provided with a cradle 40 made by folding a cradle blank 41, about fold lines 42 and 43, so as to form a box-like insert, of channel section, having a base 44 and sides 45 and 46. The sides 46 are each provided with two upper holes 19 and lower holes 18, the terms 'upper' and 'lower' relating to the erected condition of the cradle 40.

With reference to FIGS. 14 and 15, the cradle 40 is provided with an absorbent pack 49 which is bonded to the base 44 and the cradle 40 is in turn bonded to the base 11 of the body-receiving portion 2. The whole provides means for at least restricting out-leakage of body fluids from the funeral casket 1. The absorbent pack 49 which, like the blank 41, is of biodegradable Kraft carton board, comprises in effect a piece of corrugated packing, but with one of the outer coverings removed. Thus the rectangular pack 49 comprises a base 51 of plain card material (FIG. 15), covered by a sheet of corrugated card 52 (FIG. 14), with the troughs of the corrugations 53 thereof facing upwardly, so as to form channels for the receipt of any body fluids. However, the pack 49 could comprise more than one sheet of corrugated card. It should be appreciated that some versions of the casket may not be provided with the cradle and or the absorbent pack 49.

The sheet of corrugated card of the absorbent packaging is formed with parallel cuts extending substantially perpendicular to the troughs of the corrugated sheet. The cuts increase the absorption speed of any body fluids by allowing such fluids to enter the pack through the cuts. Furthermore the cuts, together with the corrugations, enable the pack 49 to act as a cushion for a body contained by the casket so as to distribute the pressure exerted by said body on the pack 49.

The cradle 40 is a close fit within the interior 7 (FIG. 2) of the casket 1, whereby the upturned sides 46 combine with blank extensions 14 in providing the body-receiving portion 2 of the casket 1 with double side walls 2*b*, and to give the portion 2 added strength and maintain the structural integrity of the casket. The absorbent pack 49 increases the rigidity of the body-receiving portion 2 by acting as a stiffening board. Fold lines 13, 15, 23 and 27 allow for the accommodation of the cradle 40 and the absorbent pack 49 when the body-receiving portion 2 is in the fully-folded collapsed condition.

FIG. 16 illustrates a shroud base 60 of pure cotton. The shroud base 60 is bonded to inner facing surfaces of the gussets 20 and the sides 14. The shroud base is also bonded to both inner and outer facing surfaces of sides 46 and to the uppermost layer of corrugated card 52. The bonding of the shroud base 60 in this way enhances the 'live hinge' action of fold lines 23, reinforces the total strength of the body-receiving portion 2 and provides an aesthetically pleasing interior. The shroud base 60 has attached thereto a rectangular shroud (not shown) the length of which is sufficient to cover a body inside the casket 1. The shroud base 60 filters out solid matter and allows fluids to be absorbed by the absorbent pack 49.

The funeral casket 1 is provided with two ribbons 35. Each ribbon 35 is threaded first through a hole 70 provided in the bevelled edges 5 of lid portion 3, then through the upper holes 17 and 19, which are positioned to be substantially in register, and then down through the lower hole 18 and out through lower hole 16. The ribbon is then passed underneath the body-receiving portion to be fed up through holes 16, 18, 19 and 17 on the other side of the casket in the same fashion.

The ribbons 35 are provided initially to secure together a package comprising the body-receiving portion 2 (when folded) and the applied lid portion 3 for transportation and storage. As shown in FIGS. 4 to 12, after untying the ribbons and removal of the lid, by pulling the ribbons 35 up and away from the body-receiving portion 2, to exert vertical tension on the ribbons, the ribbons are then used to erect the body-receiving portion 2 from a fully-folded condition to a fully-opened condition.

The positioning of each pair of holes 16 and 17, one 17 vertically above the other 16 (in the erected condition), and on opposite sides of the respective diagonal fold line 24, causes the articulated portions of each of the side walls 14 to be urged to a coplanar condition by exertion of vertical tension on the ribbons.

The fold lines 26 and 27 act as 'live hinges', with a memory that is reactivated-when the ribbons 25 are pulled vertically. The ribbons may then be used to secure the lid portion 3 on the erected body-receiving portion 2. The ribbons 35 may subsequently be used to lower the assembled casket 1 into a grave.

The interior and/or exterior of the body-receiving portion 2 may be covered with a coating such as wax, to at least restrict any outleakage of body fluids from the funeral casket.

The extensions 12 and 45 may be provided with suitably sized apertures to allow the funeral casket to be carried. The apertures are preferably located so that the end portions of extensions 12 act as walls to prevent a user's hand from coming into contact with the contents of the casket.

What is claimed is:

1. A funeral casket in the form of a box, comprising a body-receiving portion and a lid portion for covering the body-receiving portion, the body-receiving portion being of foldable construction such that the body-receiving portion is collapsible to adopt a relatively compact collapsed condition and may be erected to adopt a relatively upright erected condition, said body-receiving portion comprises a folded blank, the blank comprising a base of oblong-rectangular form, the base having opposite ends and opposite sides, a pair of first extensions disposed at said opposite ends of the base and connected to the base by respective first extension fold lines, the first extensions having been folded inwards on said first extension fold lines so as to form opposite ends of the body-receiving portion, and a pair of second extensions disposed at said opposite sides of said base and connected to the base by respective second extension fold lines and folded inwards about said second extension fold lines so as to form sides of the body-receiving portion, said first and second extensions are bounded by extension margins that extend transversely of said extension fold of the respective extension, and adjacent said extension margins of said first and second extensions are connected together by respective corner connection means, wherein at least one wall pair of a pair of end walls and a pair of side walls comprises articulated wall portions which fold relative to one another on bringing the body-receiving portion from the collapsed condition to the erected condition, said articulated wall portions being connected by a pair of inclined fold lines which each extend from a corner of said base at opposite ends of said walls of said one wall pair, said inclined fold lines being inclined relative to the respective said extension fold line of said articulated wall, whereby the other wall pair of said pairs of end walls and side walls maintains the same outline shape on collapsing of said body-receiving portion by folding of said walls of said other pair about the respective said extension fold lines.

2. A funeral casket as claimed in claim 1, wherein said corner connection means comprise four corner gussets of said blank, said corner gussets each being of rectangular shape in the blank and being bisected by a diagonal fold line extending from the respectively adjacent corner of the base, said corner gussets being maintained in a folded triangular shape both in the collapsed and in the erected condition of the body-receiving portion.

3. A funeral casket as claimed in claim 2, wherein one pair of said first and second extensions comprises respective extension tabs, said folded corner gussets being held towards said one pair of extensions by said extension tabs that have been folded over the corner gussets.

4. A funeral casket as claimed in claim 3, comprising a cradle formed from a cradle blank, said cradle blank comprising a rectangular cradle base seated on said base of said folded blank, and first and second pairs of cradle extensions disposed at opposite ends and sides of the cradle base, said first cradle extensions being sandwiched between said folded corner gussets and said one pair of extensions of said folded blank, whereby said first pairs of cradle extensions reinforce said one pair of extensions of said folded blank.

5. A funeral casket as claimed in claim 1, in which the funeral casket comprises filamentary members positioned to secure the body-receiving portion and the lid portion together.

6. A funeral casket as claimed in claim 1, in which said articulated walls portions are provided with pairs of holes, the holes of a pair being positioned substantially vertically of one another in the erected condition of the body-receiving portion, and with one hold of each pair being above a respective one of said inclined fold lines, with the other hole of each pair being below said inclined fold line, a respective filamentary member extending through each pair of holes, whereby on vertical tensioning of said filamentary member, said articulated wall-portions are urged towards a coplanar, vertical orientation to erect said articulated wall portions to form an erect vertical wall.

7. A funeral casket as claimed in claim 1, in which the body-receiving portion contains shroud material which is attached to an interior surface of the body-receiving portion.

8. A funeral casket as claimed in claim 1, in which the body-receiving portion is provided with means for at least restricting outleakage of body fluids from the funeral casket.

9. A funeral casket as claimed in claim 1, in which the funeral casket is of biodegradable material.

* * * * *